US006425387B1

(12) United States Patent
Rohback, Jr.

(10) Patent No.: US 6,425,387 B1
(45) Date of Patent: Jul. 30, 2002

(54) PORTABLE DEVICE FOR CONTAINING A CAMPFIRE THEREIN

(76) Inventor: John Rohback, Jr., 72 Rhoda Ave., North Babylon, NY (US) 11703

( * ) Notice: Subject to any disclaimer, the term of this patent is extended or adjusted under 35 U.S.C. 154(b) by 29 days.

(21) Appl. No.: 09/713,283

(22) Filed: Jul. 5, 2000

(51) Int. Cl.[7] ..... F24C 1/16

(52) U.S. Cl. ..... 126/9 R; 126/29; 126/38; 126/152 A

(58) Field of Search ..... 126/9 R, 9 B, 126/25 R, 29, 30, 38, 39 B, 39 E, 152 R, 152 A, 152 B, 153, 544, 547, 201; 431/343

(56) References Cited

U.S. PATENT DOCUMENTS

| | | | | | |
|---|---|---|---|---|---|
| 795,646 | A | * | 7/1905 | Plummer | 126/544 |
| 955,140 | A | * | 4/1910 | Cronk | 126/30 |
| 1,102,649 | A | | 7/1914 | Dix | 126/29 |
| 3,146,773 | A | * | 9/1964 | Melzer | 126/9 R |
| 3,724,440 | A | * | 4/1973 | Clark et al. | 126/9 R |
| 4,126,116 | A | * | 11/1978 | McCallum | 126/9 R |
| 4,363,313 | A | | 12/1982 | Smith | 126/9 R |
| 4,455,992 | A | * | 6/1984 | Hsiao | 126/9 R |
| 4,794,906 | A | * | 1/1989 | Longley, Jr. | 126/9 R |
| 4,829,977 | A | | 5/1989 | Valentine | 126/9 R |
| 5,329,917 | A | | 7/1994 | Young | 126/29 |
| 5,575,195 | A | * | 11/1996 | Foxford | 126/9 R |
| 5,711,210 | A | * | 1/1998 | Kaufman | 126/9 R |
| 5,782,224 | A | * | 7/1998 | Rabell | 126/9 R |

FOREIGN PATENT DOCUMENTS

| | | | | |
|---|---|---|---|---|
| GB | 6676 | | 3/1927 | 126/30 |
| GB | 308104 | * | 3/1929 | |

* cited by examiner

*Primary Examiner*—Henry Bennett
*Assistant Examiner*—Josiah C. Cocks
(74) *Attorney, Agent, or Firm*—Richard L. Miller

(57) ABSTRACT

A portable device for containing a campfire therein that includes a plurality of panels, hinges, a hinge/fastening joint, a plurality of grates, a burner, and a pouch. Each panel has four finger-receiving throughbores for receiving the four fingers of a user for facilitating transport, a pair of tabs, a pair of throughslots that receive the pair of tabs of an adjacent panel so as to form a pivoting joint. The plurality of grates rest on the plurality of panels and are held foldingly to each other by links. The burner rests through aligned finger receiving throughbores in an outermost pair of opposing panels and includes a head that has a pair of legs, a pipe that rests in a finger receiving throughbore in the other opposing panel, and a control valve for communicating with a gas source and which is disposed externally to the other opposing panel. The pouch replaceably contains, for storage and transport, the plurality of panels folded upon themselves in an accordion fashion, the plurality of grates stacked upon themselves, and the burner, and has an external strap that encircles the pouch and a pair of internal straps that encircle the plurality of panels so as to not only tightly hold the plurality of panels in their folded accordion configuration, but to also allow the plurality of panels to unwarp when warped by the campfire.

32 Claims, 2 Drawing Sheets

FIG.1
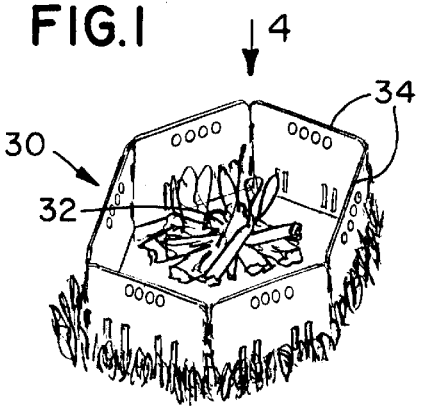
FIG.2
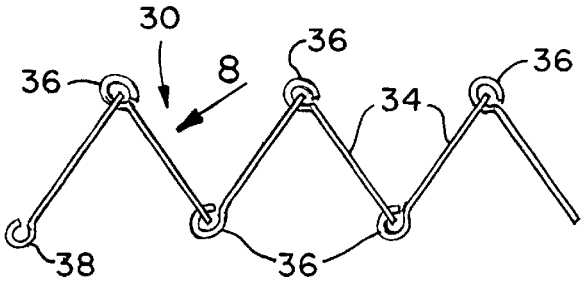
FIG.3
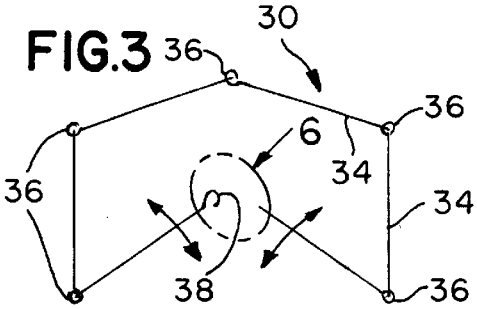
FIG.4
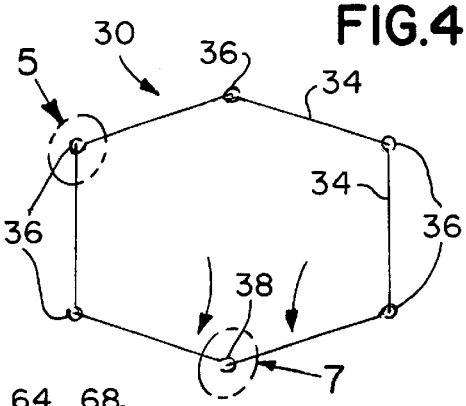
FIG.5
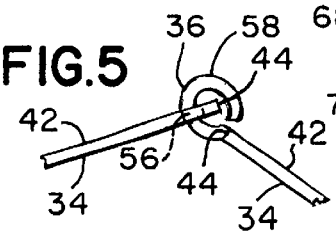
FIG.16
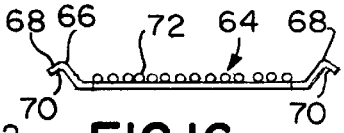
FIG.6
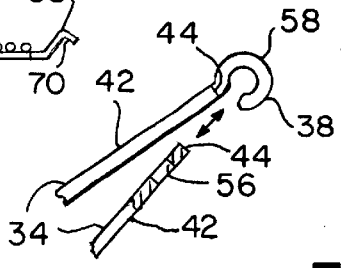
FIG.8
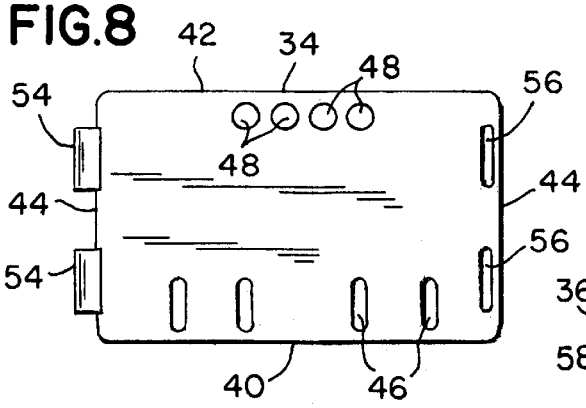
FIG.7
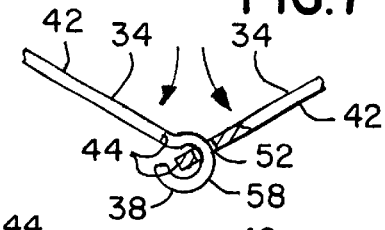
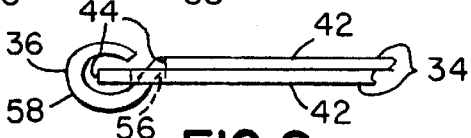
FIG.9

PORTABLE DEVICE FOR CONTAINING A CAMPFIRE THEREIN

CROSS REFERENCE TO RELATED APPLICATIONS

The instant application is a refile of application Ser. No. 09/170,158, filed Oct. 13, 1998, and now abandoned.

BACKGROUND OF THE INVENTION

1. Field of the Invention

The present invention relates to a portable device. More particularly, the present invention relates to a portable device for containing a campfire therein.

2. Description of the Prior Art

Numerous innovations for campfire related devices have been provided in the prior art that will be described. Even though these innovations may be suitable for the specific individual purposes to which they address, however, they differ from the present invention.

A FIRST EXAMPLE, U.S. Pat. No. 1,102,649 to Dix teaches a collapsible grate comprising in combination, parallel walls, each comprising wall sections pivoted together vertically, so as to fold to lie in juxtaposed relation to each other, and a trellis-like top grid having pivotal connection with said walls at one end thereof, said top grid including a plurality of cross strips having their ends turned downwardly at substantially right angles to the body of the strip, said down turned ends being disposed in coacting pairs and adapted to lie one at the inner side and the other at the outer side and against said wall sections, to retain said walls in spaced apart parallel relation to each other.

A SECOND EXAMPLE, U.S. Pat. No. 4,363,313 to Smith teaches a portable campfire fireplace for containing a campfire and for providing a cooking surface which is adjustable with respect to the fire, in which side walls form a firebox and are hinged to fold flat, side by side. A post extends upwardly from eyes at one corner of the firebox and a bracket for holding a grill is slidable and rotatable on the post. A collar and set screw hold the bracket in place on the post. All pieces of the fireplace can be attached to one wall of the firebox for storing and transporting the fireplace. A false bottom may be disposed in the firebox for charcoal cooking, to hold the charcoal near the top of the firebox.

A THIRD EXAMPLE, U.S. Pat. No. 4,829,977 to Valentine teaches a portable campfire cooker formed of metal walls, posts, grills and other parts, easily assembled and disassembled, providing a rigid and safe fire box. Cylindrical posts lock together interconnecting walls, which walls reciprocally support these posts against inadvertent displacement. Grill supports and pot supports are rotatably mounted on these posts in a secure arrangement. Spit members are similarly mounted onto these posts. Grill, pot and spit members are released by merely lifting from these posts. The walls can be of selected unit lengths to form polygonal shaped fire boxes of symmetrical or non-symmetrical configurations.

A FOURTH EXAMPLE, U.S. Pat. No. 5,329,917 to Young teaches a portable fire ring that comprises a plurality of curved sections which are secured together in an end-to-end relationship to form a semi-circle. A grill extension is then assembled and connected to the ends of the semi-circle. A pivotal grill extends over the grill extension to permit the fire chamber of the grill section to be opened to enable coals to be placed in the fire chamber. Disassembled, the fire ring may be lifted and moved to the desired position or moved to a new location. The portable fire ring is easily assembled and disassembled and may be carried in a bag or the like when disassembled.

It is apparent that numerous innovations for campfire related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a portable device for containing a campfire therein that avoids the disadvantages of the prior art.

ANOTHER OBJECT of the present invention is to provide a portable device for containing a campfire therein that is simple and inexpensive to manufacture.

STILL ANOTHER OBJECT of the present invention is to provide a portable device for containing a campfire therein that is simple to use.

BRIEFLY STATED, YET ANOTHER OBJECT of the present invention is to provide a portable device for containing a campfire therein that includes a plurality of panels, hinges, a hinge/fastening joint, a plurality of grates, a burner, and a pouch. Each panel has four finger-receiving throughbores for receiving the four fingers of a user for facilitating transport, a pair of tabs, a pair of throughslots that receive the pair of tabs of an adjacent panel so as to form a pivoting joint. The plurality of grates rest on the plurality of panels and are held foldingly to each other by links. The burner rests through aligned finger receiving throughbores in an outermost pair of opposing panels and includes a head that has a pair of legs, a pipe that rests in a finger receiving throughbore in the other opposing panel, and a control valve for communicating with a gas source and which is disposed externally to the other opposing panel. The pouch replaceably contains, for storage and transport, the plurality of panels folded upon themselves in an accordion fashion, the plurality of grates stacked upon themselves, and the burner, and has an external strap that encircles the pouch and a pair of internal straps that encircle the plurality of panels so as to not only tightly hold the plurality of panels in their folded accordion configuration, but to also allow the plurality of panels to unwarp when warped by the campfire, The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the six panel portion of the present invention formed into a hexagonal configuration and in use;

FIG. 2 is a diagrammatic top plan view of the six panel portion partially unfolded, prior to use;

FIG. 3 is a diagrammatic top plan view of the six panel portion unfolded, but not hooked together;

FIG. 4 is a diagrammatic top plan view taken generally in the direction of arrow 4 in FIG. 1 of the six panel portion unfolded and hooked together to form a hexagonal configuration;

FIG. 5 is an enlarged diagrammatic top plan view of the area generally enclosed by the dotted curve identified by arrow 5 in FIG. 4 of a hinge of the six panel portion during use;

FIG. 6 is an enlarged diagrammatic top plan view of the area generally enclosed by the dotted curve identified by arrow 6 in FIG. 3 of the hooking components of the six panel portion just prior to mutual engagement;

FIG. 7 is an enlarged diagrammatic top plan view of the area generally enclosed by the dotted curve identified by arrow 7 in FIG. 4 of the hooking components of the six panel portion after mutual engagement;

FIG. 8 is an enlarged diagrammatic front elevational view taken generally in the direction of arrow 8 in FIG. 2 of a panel of the six panel portion;

FIG. 9 is an enlarged diagrammatic top plan view of the hinge of the six panel portion shown in FIG. 5, but with a pair of adjacent panels folded upon themselves, as exemplary for storage;

FIG. 16 is diagrammatic side elevational view taken generally in the direction of arrow 16 in FIG. 15;

LIST OF REFERENCE NUMERALS UTILIZED IN THE DRAWING

Figures 10, 11, 12, 13, 14, 15, 17, 18, 19, 20, 21, 22, 23:
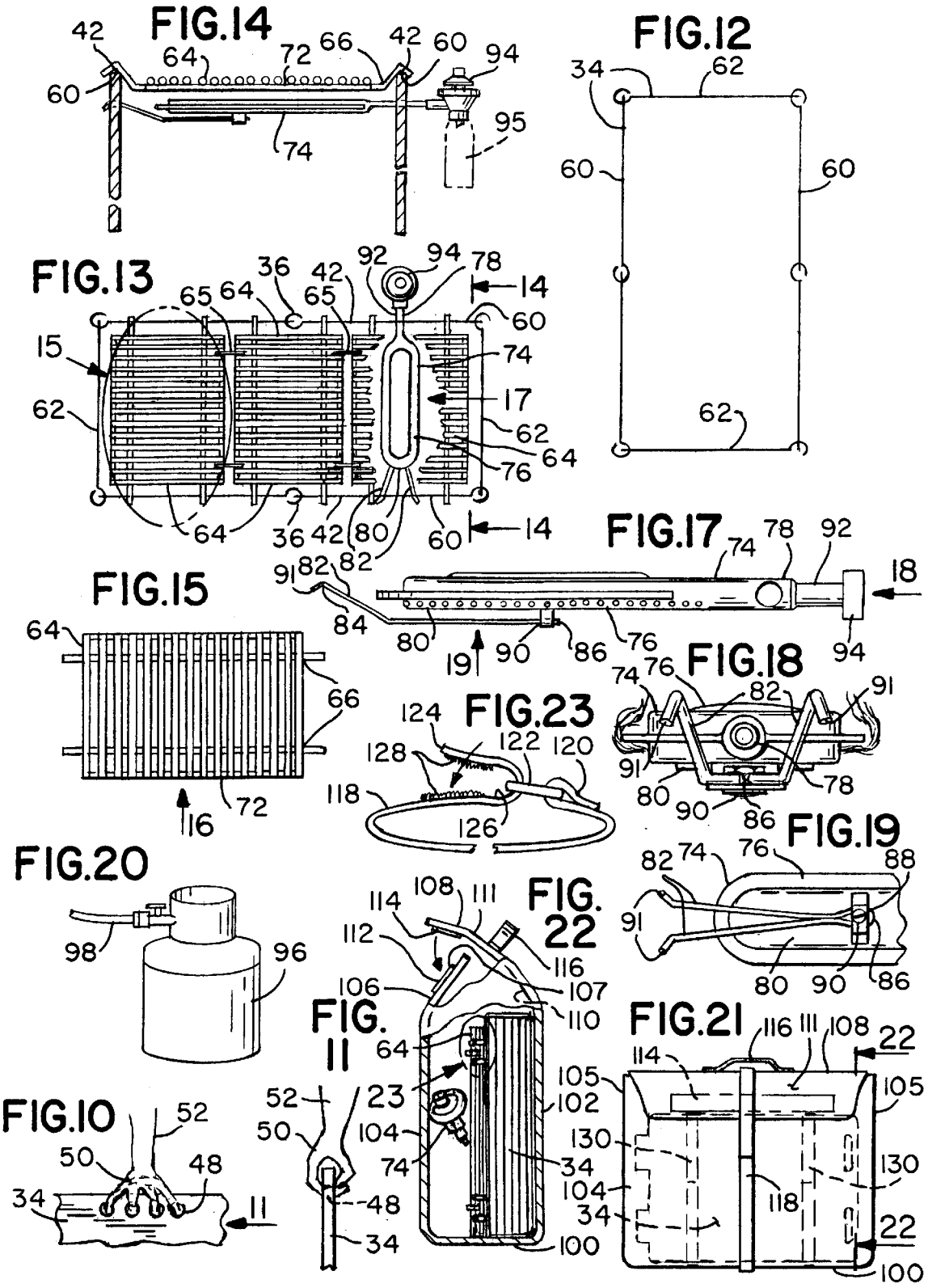
FIG. 10 is a diagrammatic front elevational view of the holes in a panel being utilized for carrying the panel.
FIG. 11 is a diagrammatic end elevational view taken generally in the direction of arrow 11 in FIG. 10.
FIG. 12 is a diagrammatic top plan view of the six panel portion of the present invention formed into a rectangular configuration.
FIG. 13 is a diagrammatic top plan view of the three grill portion of the present invention on the six panel portion.
FIG. 14 is a diagrammatic cross sectional view taken on line 14—14 in FIG. 13.
FIG. 15 is an enlarged diagramatic top plan view of the area generally enclosed by the dotted curve identified by arrow 15 in FIG. 13 of a grill of the three grill portion.
FIG. 17 is an enlarged diagrammatic side elevational view taken generally in the direction of arrow 17 in FIG. 13 of the burner portion of the present invention.
FIG. 18 is an enlarged diagramatic end elevational view taken generally in the direction of arrow 18 in FIG. 17.
FIG. 19 is a diagrammatic bottom plan view taken generally in the direction of arrow 19 in FIG. 17.
FIG. 20 is a diagrammatic perspective view of tank of propane for powering the burner unit.
FIG. 21 is a diagrammatic front elevational view of the various operating components of the present invention being stored in a pouch.
FIG. 22 is a diagrammatic cross sectional view taken on line 22—22 in FIG. 21.
FIG. 23 is an enlarged diagrammatic side elevational view of the area generally enclosed by the dotted curve identified by arrow 23 in FIG. 22 of a locking strap of the present invention.Z

30 portable device of present invention for containing campfire 32 therein
32 campfire
34 plurality of panels for encircling campfire 32
36 hinges
38 hinge/fastening joint
40 ground-engaging lowermost long edge of each panel of plurality of panels 34
42 ambient-engaging uppermost long edge of each panel of plurality of panels 34
44 pair of interlocking short side edges of each panel of plurality of panels 34
46 plurality of draft throughslots in each panel of plurality of panels 34
48 four finger-receiving throughbores in each panel of plurality of panels 34 for receiving four fingers 50 of user 52 for facilitating transport
50 four fingers of user 52
52 user
54 pair of tabs on each panel of plurality of panels 34
56 pair of throughslots in each panel of plurality of panels 34
58 pivoting joint
60 long sides of plurality of panels 34
62 short sides of plurality of panels 34
64 plurality of grates
65 links of plurality of grates 64
66 pair of runners of each grate of plurality of grates 64
68 pair of free ends of each runner 66 of pair of runners 66 of each grate of plurality of grates 64
70 hook formed on each free end of pair of free ends 68 of each runner of pair of runners 66 of each grate of plurality of grates 64
72 plurality of cross members of each grate of plurality of grates 64
74 burner
76 head of burner 74
78 proximal end of head 76 of burner 74
80 distal end of head 76 of burner 74
82 pair of legs of burner 74
84 pair of free ends of single rod of pair of legs 82 of burner 74
86 midpoint of single rod of pair of legs 82 of burner 74
88 loop at midpoint 86 of single rod of pair of legs 82 of burner 74
90 screw clamp of burner 74
91 pair of hooks formed from pair of free ends 84 of single rod of pair of legs 82 of burner 74
92 pipe of head 76 of burner 74
94 control valve of head 76 of burner 74 for communicating with gas source
95 direct can of propane of gas source for direct attachment to control valve 94 of head 76 of burner 74
96 remote tank of propane of gas source for attachment to control valve 94 of head 76 of burner 74 by way of hose 98
98 hose of remote tank of propane 96 of gas source
99 pouch
100 bottom wall of pouch 99
102 back wall of pouch 99
104 front wall of pouch 99
105 pair of side walls of pouch 99
106 front flap of pouch 99
107 outermost surface of front flap 106 of flap 99
108 rear flap of pouch 99
110 innermost surface of rear flap 108 of pouch 99
111 outermost surface of rear flap 108 of pouch 99
112 first portion of hook and loop fasteners of pouch 99
114 second portion of hook and loop fasteners of pouch 99
116 handle of pouch 99
118 external strap of pouch 99
120 one end of external strap 118 of pouch 99
122 ring on one end 120 of external strap 118 of pouch 99
124 other end of external strap 118 of pouch 99
126 outermost surface of other end 124 of external strap 118 of pouch 99

128 mating portions of hook and loop fasteners on outermost surface 126 of other end 124 of external strap 118 of pouch 99

130 pair of internal straps of pouch 99

DETAILED DESCRIPTION OF THE PREFERRED EMBODIMENT

Referring now to the figures, in which like numerals indicate like parts, and particularly to FIG. 1, the portable device of the present invention is shown generally at 30 for containing a campfire 32 therein.

The general configuration of the portable device 30 can best be seen in FIGS. 1–4, and as such, will be discussed with reference thereto.

The portable device 30 comprises a plurality of panels 34 for encircling the campfire 32.

The portable device 30 further comprises hinges 36 that interlock a panel 34 to an adjacent panel 34.

The portable device 30 further comprises a hinge/fastening joint 38 that allows selective separation of one pair of adjacent panels 34.

The specific configuration of a panel 34, a hinge 36, and the hinge fastening joint 38 can best be seen in FIGS. 5–11, and as such, will be discussed with reference thereto.

The plurality of panels 34 are even in number, but are preferably six, and are formed into a configuration that is one of hexagonal and rectangular.

Each panel 34 is flat, thin, rectangular-shaped, and has a ground-engaging lowermost long edge 40 that is horizontally-oriented, an ambient-engaging uppermost long edge 42 that is horizontally-oriented, and a pair of interlocking short side edges 44 that are vertically-oriented.

Each panel 34 further has a plurality of draft throughslots 46 that are spaced parallel to each other and extend vertically from just above the ground-engaging lowermost long edge 40 thereof to way below the ambient-engaging uppermost long edge 42 thereof.

Each panel 34 further has four finger-receiving throughbores 48 that are in close proximity to each other and disposed in line and just below the ambient-engaging uppermost long edge 42 thereof for receiving the four fingers 50 of a user 52 for facilitating transport.

Each panel 34 further has a pair of tabs 54 that are vertically spaced along and extend horizontally curvingly outwardly from one interlocking short side edge 44 thereof, and when viewed in plane, are circular-shaped.

Each panel 34 further has a pair of throughslots 56 that are vertically spaced along, and extend just inward of, and parallel to, the other interlocking short side edge 44 thereof, The pair of throughslots 56 in each panel 34 are so positioned so as to receive the pair of tabs 54 of an adjacent panel 34 so as to form a pivoting joint 58.

The pair of tabs 54 are prevented from exiting the pair of throughslots 56 when the pivoting joint 58 functions as the hinge 36.

The pair of tabs 54 are allowed to selectively exit the pair of throughslots 56 when the pivoting joint 58 functions as the hinge/fastening joint 38, and when removed, the plurality of panels 34 are allowed to fold upon themselves in an accordion fashion for flat storage.

As shown in FIGS. 12–20, the plurality of panels 34 are formed into a rectangular configuration, with two pair of the panels 34 being collinear and forming long sides 60 and a remaining pair of panels 34 being perpendicular thereto and forming short sides 62 so as to be utilized for grilling.

As shown in FIGS. 13–16, the portable device 30 further comprises a plurality of grates 64, which are preferably three in number, and which rest on the ambient-engaging uppermost long edges 42 of the long sides 60 of the plurality of panels 34, are disposed side-by-side, and are held foldingly to each other by links 65.

Each grate 64 comprises a pair of runners 66 that are rod-shaped and spaced parallel to each other.

Each runner 66 of each grate 64 terminates in a pair of free ends 68.

Each free end 68 of each runner 66 first extends skewly upwardly outwardly, then extends skewly downwardly outwardly so as to form a hook 70 that captures the ambient-engaging uppermost long edges 42 of the long sides 60 of the plurality of panels 34.

The pair of runners 66 of a middle grate 64 straddle a pair of opposing hinges 36 of the long sides 60 so as to maintain the pair of opposing hinges 36 rigid during use.

Each grate 64 further comprises a plurality of cross members 72 that are rod-shaped, extend perpendicularly transversely across the pair of runners 66 thereof, and are spaced parallel to each other so as to form a matrix.

As shown in FIGS. 13, 14, and 17–20, the portable device 30 further comprises a burner 74 that rests through aligned finger receiving throughbores 48 in an outermost pair of opposing panels 34 of the long sides 60 of the plurality of panels 34.

The burner 74 comprises a head 76 which is substantially flat, slender, elongated, extends parallel to, and under, the runners 66 of the grates 64, and has a proximal end 78 and a distal end 80.

The burner 74 further comprises a pair of legs 82 that extend outwardly from the distal end 80 of, and under, the head 76 thereof.

The pair of legs 82 are formed from a single rod having a pair of free ends 84 and a midpoint 86 that is midway between the pair of free ends 84 thereof.

The single rod of the burner 74 is bent upon itself at the midpoint 86 thereof to form a loop 88.

The loop 88 of the single rod is affixed under, and to, the head 76 by a screw clamp 90.

The single rod extends first outwardly from the loop 88, parallel to the head 76 as the pair of legs 82 thereof, then skewly upwardly and outwardly therefrom, past the distal end 80 of the head 76, to the pair of free ends 84 thereof which depend skewly and outwardly so as to from a pair of hooks 86 that are captured in a pair of finger receiving throughbores 48 in one opposing panel 34 of one long side 60 of the plurality of panels 34.

The head 76 further has a pipe 92 that extends coaxially from, and is in fluid communication with, the proximal end 78 thereof, and rests in a finger receiving throughbore 48 in the other opposing panel 34 of the other long side 60 of the plurality of panels 34.

The head 76 further has a control valve 94 for communicating with a gas source, and which extends coaxially from, and is in fluid communication with, the pipe 92 thereof, and is disposed externally to the other opposing panel 34 of the other long side 60 of the plurality of panels 34.

As shown in FIGS. 14 and 20, respectively, the gas source is propane gas packaged in one of a direct can 95 for direct attachment to the control valve 94 and a remote tank 96 for attachment to the control valve 94 by way of a hose 98.

As shown in FIGS. 21–23, the portable device 30 further comprises a pouch 99 that replaceably contains, for storage and transport, the plurality of panels 34 folded upon themselves in an accordion fashion, the plurality of grates 64 stacked upon themselves and lie adjacent to the plurality of panels 34, and the burner 74 that lies adjacent the plurality of grates 64.

The pouch 99 has a bottom wall 100, a back wall 102 that extends upwardly from the bottom wall 100 thereof, a front wall 104 that extends upwardly from the bottom wall 100 thereof, a pair of side walls 105 that extend upwardly from the bottom wall 100 thereof, a front flap 106 that extends coplanarly from the front wall 104 thereof and has an outermost surface 107, a rear flap 108 that extends coplanarly from the rear well 102 thereof and has an innermost surface 110 and an outermost surface 111, a first portion of hook and loop fasteners 112 disposed on the outermost surface 107 of the front flap 106, a second portion of hook and loop fasteners 114 disposed on the innermost surface 110 of the rear flap 108 and which selectively engage with the first portion of hook and loop fasteners 112 thereof, and a handle 116 disposed across the outermost surface 111 of the rear flap 108 thereof.

The plurality of panels 34 rest upon the bottom wall 100 of the pouch 99 and the back wall 102, the plurality of grates 64 rest upon the bottom wall 100, adjacent to the plurality of panels 34, the burner 74 rest upon the bottom wall 100 adjacent to the plurality of grates 64 and the front wall 104, the front flap 106 folds rearwardly over the plurality of panels 34, the rear flap 108 folds forwardly over the front flap 106, and the second portion of hook and loop fasteners 114 engage with the first portion of hook and loop fasteners 112 to close the pouch 98, and disengage to open the pouch 99.

The pouch 99 further has an external strap 118 that encircles the pouch 99, through the handle 116, to further maintain the pouch closed.

The external strap 118 is slender, elongated, and has one end/120 capturing a ring 122 and the other end 124 being free and having an outermost surface 126.

The outermost surface 126 of the other end 124 of the external strap 118 has mating portions of hook and loop fasteners 128 disposed adjacent therealong, wherein the external strap 118 wraps around the pouch 99, through the handle 116, and the other end 124 passes through the ring 122, is pulled tight, and the mating portions of hook and loop fasteners 128 engage each other.

The pouch 99 further has a pair of internal straps 130 which are configured exactly like the external strap 118, but encircle the plurality of panels 34 so as to not only tightly hold the plurality of panels in their folded accordion configuration, but to also allow the plurality of panels to unwarp when warped by the campfire 12.

It will be understood that each of the elements described above, or two or more together, may also find a useful application in other types of constructions differing from the types described above.

While the invention has been illustrated and described as embodied in a portable device for containing a campfire therein, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable device for containing a campfire therein, comprising:

a) a plurality of panels for encircling the campfire;

b) hinges interlocking a panel to an adjacent panel; and c) a hinge/fastening joint allowing selective separation of one pair of adjacent panels, wherein each panel is flat, thin, rectangular-shaped, and has:

i) a ground-engaging lowermost long edge that is horizontally-oriented;

ii) an ambient-engaging uppermost long edge that is horizontally-oriented; and iii) a pair of interlocking short side edges that are vertically-oriented, wherein each panel further has a plurality of draft throughslots that are spaced parallel to each other and extend vertically from just above said ground-engaging lowermost long edge thereof to below said ambient-engaging uppermost long edge thereof, wherein each panel further has four finger-receiving throughbores that are in close proximity to each other and disposed in line and just below said ambient-engaging uppermost long edge thereof for receiving the four fingers of a user for facilitating transport.

2. The device as defined in claim 1, wherein said plurality of panels are even in number.

3. The device as defined in claim 1, wherein said plurality of panels are six in number and are formed into a configuration that is one of hexagonal and rectangular.

4. The device as defined in claim 1, wherein each panel further has a pair of tabs that are vertically spaced along and extend horizontally curvingly outwardly from one interlocking short side edge thereof, and when viewed in plane, are circular-shaped.

5. The device as defined in claim 4, wherein each panel further has a pair of throughslots that are vertically spaced along, and extend just inward of, and parallel to, the other interlocking short side edge thereof.

6. The device as defined in claim 5, wherein said pair of throughslots in each panel are so positioned so as to receive said pair of tabs of an adjacent panel so as to form a pivoting joint.

7. The device as defined in claim 6, wherein said pair of tabs are prevented from exiting said pair of throughslots when said pivoting joint functions as said hinge.

8. The device as defined in claim 6, wherein said pair of tabs are allowed to selectively exit said pair of throughslots when said pivoting joint functions as said hinge/fastening joint, and when removed, said plurality of panels are allowed to fold upon themselves in an accordion fashion for flat storage.

9. A portable device for containing a campfire therein, comprising:

a) a plurality of panels for encircling the campfire;

b) hinges interlocking a panel to an adjacent panel; and c) a hinge/fastening joint allowing selective separation of one pair of adjacent panels, wherein each panel is flat, thin, rectangular-shaped, and has:

i) a ground-engaging lowermost long edge that is horizontally-oriented;

ii) an ambient-engaging uppermost long edge that is horizontally-oriented; and iii) a pair of interlocking short side edges that are vertically-oriented, wherein each panel further has finger-receiving throughbores that are in close proximity to each other and disposed in line and just below said ambient-engaging uppermost long edge thereof, wherein said plurality of panels are formed into a rectangular configuration, with two pair of said panels being collinear and forming long sides and a remaining pair of panels being perpendicular thereto and forming short sides so as to be utilized for grilling; further comprising a plurality of grates resting on said ambient-engaging uppermost long edges of said long sides of said plurality of panels, are disposed side-by-side, and are held foldingly to each other by links, wherein each grate comprises a pair of runners that are rod-shaped and spaced parallel to each other; further comprising a burner aligned with and resting through said finger receiving throughbores in an outermost pair of opposing panels of said long sides of said plurality of panels.

10. The device as defined in claim 9, wherein said plurality of grates are three in number.

11. The device as defined in claim 9, wherein each runner of each grate terminates in a pair of free ends.

12. The device as defined in claim 11, wherein each free end of each runner first extends skewly upwardly outwardly, then extends skewly downwardly outwardly so as to form a hook that captures said ambient-engaging uppermost long edges of said long sides of said plurality of panels.

13. The device as defined in claim 9, wherein said pair of runners of a middle grate straddle a pair of opposing hinges of said long sides so as to maintain said pair of opposing hinges rigid during use.

14. The device as defined in claim 9, wherein each grate further comprises a plurality of cross members that are rod-shaped, extend perpendicularly transversely across said pair of runners thereof, and are spaced parallel to each other so as to form a matrix.

15. The device as defined in claim 9, wherein said burner comprises a head which is substantially flat, slender, elongated, extends parallel to, and under, said runners of said grates, and has;

a) a proximal end; and b) a distal end.

16. The device as defined in claim 15, wherein said burner further comprises a pair of legs that extend outwardly from said distal end of, and under, said head thereof.

17. The device as defined in claim 16, wherein said pair of legs are formed from a single rod having:

a) a pair of free ends; and b) a midpoint that is midway between said pair of free ends thereof.

18. The device as defined in claim 17, wherein said single rod of said burner is bent upon itself at said midpoint thereof to form a loop.

19. The device as defined in claim 18, wherein said loop of said single rod is affixed under, and to, said head by a screw clamp.

20. The device as defined in claim 18, wherein said single rod extends first outwardly from said loop, parallel to said head, as said pair of legs thereof, then skewly upwardly and outwardly therefrom, past said distal end of said head, to said pair of free ends thereof which depend skewly and outwardly so as to from a pair of hooks that are captured in a pair of finger receiving throughbores in one opposing panel of one long side of said plurality of panels.

21. The device as defined in claim 20, wherein said head further has a pipe that extends coaxially from, and is in fluid communication with, said proximal end thereof, and rests in a finger receiving throughbore in the other opposing panel of the other long side of said plurality of panels.

22. The device as defined in claim 21, wherein said head further has a control valve for communicating with a gas source, and which extends coaxially from, and is in fluid communication with, said pipe thereof, and is disposed externally to said other opposing panel of said other long side of said plurality of panels.

23. The device as defined in claim 22, wherein the gas source is propane gas packaged in one of a direct can for direct attachment to said control valve and a remote can for attachment to said control valve by way of a hose.

24. The device as defined in claim 9, further comprising a pouch replaceably containing, for storage and transport, said plurality of panels folded upon themselves in an accordion fashion, said plurality of grates stacked upon themselves and lying adjacent to said plurality of panels, and said burner lying adjacent said plurality of grates.

25. The device as defined in claim 24, wherein said pouch has:

a) a bottom wall;

b) a back wall that extends upwardly from said bottom wall thereof;

c) a front wall that extends upwardly from said bottom wall thereof;

d) a pair of side walls that extend upwardly from said bottom wall thereof;

e) a front flap that extends coplanarly from said front wall thereof and has an outermost surface;

f) a rear flap that extends coplanarly from said rear wall thereof and has:
   i) an innermost surface; and
   ii) an outermost surface;

g) a first portion of hook and loop fasteners disposed on said outermost surface of said front flap;

h) a second portion of hook and loop fasteners disposed on said innermost surface of said rear flap and which selectively engage with said first portion of hook and loop fasteners thereof; and i) a handle disposed across said outermost surface of said rear flap thereof.

26. The device as defined in claim 25, wherein said plurality of panels rest upon said bottom wall of said pouch and said back wall, said plurality of grates rest upon said bottom wall of said pouch, adjacent to said plurality of panels, said burner rest upon said bottom wall 100 of said pouch, adjacent to said plurality of grates 64 and said front wall, said front flap of said pouch folds rearwardly over said plurality of panels, said rear flap of said pouch folds forwardly over said front flap, and said second portion of hook and loop fasteners of said pouch engage with said first portion of hook and loop fasteners of said pouch to close said pouch, and disengage to open said pouch.

27. The device as defined in claim 25, wherein said pouch further has an external strap that encircles said pouch, through said handle, to further maintain said pouch closed.

28. The device as defined in claim 27, wherein said external strap is slender, elongated, and has:

a) one end capturing a ring; and b) the other end being free and having an outermost surface.

29. The device as defined in claim 28, wherein said outermost surface of said other end of said external strap has mating portions of hook and loop fasteners disposed adjacent therealong, wherein said external strap wraps around said pouch, through said handle, and said other end passes through said ring, is pulled tight, and said mating portions of hook and loop fasteners engage each other.

30. The device as defined in claim 24, wherein said pouch has a pair of internal straps that encircle said plurality of panels so as to not only tightly hold said plurality of panels in their folded accordion configuration, but to also allow said plurality of panels to unwarp when warped by said campfire.

31. The device as defined in claim 30, wherein each internal strap is slender, elongated, and has:

a) one end capturing a ring; and b) the other end being free and having an outermost surface.

32. The device as defined in claim 31, wherein said outermost surface of said other end of said internal strap has mating portions of hook and loop fasteners disposed adjacent therealong, wherein said pair of internal straps wrap around said plurality of panels, and said other ends pass, respectively, through said rings, are pulled tight, and said mating portions of hook and loop fasteners engage each other, respectively.

* * * * *